US005377594A

United States Patent [19]

Alford

[11] Patent Number: 5,377,594

[45] Date of Patent: Jan. 3, 1995

[54] FLEXIBLE LINEAR EXPLOSIVE CUTTING OR FRACTURING CHARGE

[76] Inventor: Sidney C. Alford, 41a Pickwick, Corsham, Wiltshire, England, SN13 OHX

[21] Appl. No.: 834,535

[22] PCT Filed: Aug. 14, 1990

[86] PCT No.: PCT/GB90/01277

§ 371 Date: Apr. 14, 1992

§ 102(e) Date: Apr. 14, 1992

[87] PCT Pub. No.: WO91/02939

PCT Pub. Date: Mar. 7, 1991

[30] Foreign Application Priority Data

Aug. 15, 1989 [GB] United Kingdom ..... 8918552

[51] Int. Cl.[6] ..... F42B 1/032

[52] U.S. Cl. ..... 102/308; 102/310

[58] Field of Search ..... 102/307, 308, 310

[56] References Cited

U.S. PATENT DOCUMENTS 2,981,185 4/1957 Caldwell ..... 102/20
3,177,808 4/1965 Owen ..... 102/308 X
3,185,089 5/1965 Parkhurst et al. ..... 102/307
4,815,384 3/1989 Ringel et al. ..... 102/307
4,856,430 8/1989 Gibb et al. ..... 102/307
5,075,112 12/1991 Lane .

FOREIGN PATENT DOCUMENTS 2515413 10/1976 Germany .
8804573 8/1979 Germany .

OTHER PUBLICATIONS

Rama, S. et al., *Connective Tissue Research* 12:111–118, 1984.

Lane, I. William et al., *Sharks Don't Get Cancer,* Avery Publishing Group Inc., 1992, updated edition 1993.

*Primary Examiner*—Peter A. Nelson
*Attorney, Agent, or Firm*—Finnegan, Henderson, Farabow, Garrett & Dunner

[57] ABSTRACT

The invention provides a linear explosive cutting or fracturing charge comprising a plurality of elements connected together for articulation. Each element comprises a body portion (1) defining a recess (9) for containing explosive material and connecting means (2) whereby a plurality of elements can be connected together for articulation.

16 Claims, 3 Drawing Sheets

FLEXIBLE LINEAR EXPLOSIVE CUTTING OR FRACTURING CHARGE

Figure 1:
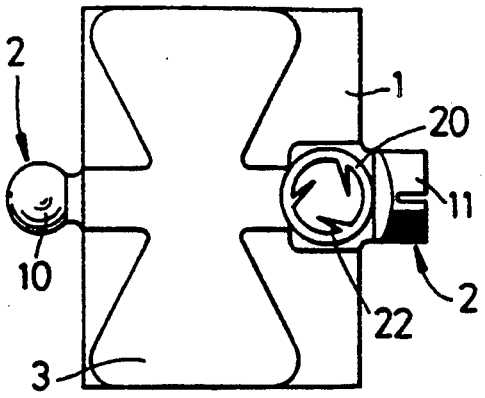

The present invention relates to linear explosive cutting or fracturing charges.

A frequent requirement of demolition work, e.g., when demolishing oil tankers or other large vessels for scrap, is the severing of steel targets by means of explosives.

Among the advantages of explosives over other methods, such as mechanical cutting methods or burning, are safety, since the operator does not need to be close to the target structure at the moment of demolition, speed, and the relative ease of transportation of the means of demolition, since explosive charges are compact in comparison with the equipment required for mechanical cutting or burning.

Explosives may be used for demolition by direct application to the target surface, although attachment is often difficult, the technique inefficient for a given quantity of explosive, and the result almost invariably disorderly and needlessly destructive for the task in hand. Also projected fragments constitute a particular hazard when this method is used.

Much greater explosive efficiency results from the use of shaped charges, such as linear cutting charges wherein a high explosive is caused to act on an angle-section strip of metal in such a way that the two limbs of the angle-section are driven towards each other, thereby generating an elongate jet of extremely fast-moving metal which has great penetrating power, even on steel targets. However, such linear cutting charges are rigid and cannot be conformed to targets which are not flat.

An alternative method of imparting directionality to the energy released by an explosive depends upon the shaping of shock waves generated by the explosive within the target. The shock waves may be caused to fracture targets according to two principle mechanisms. By initiating a mass of explosive in contact with, or close to, the target surface at its two outer extremities with respect to the plane of intending fracture, the two separate detonation wave fronts converge along the centre line, and collide. The first mechanism results from the extreme violence of such a collision which generates a narrow zone of extremely high pressure on the target surface which fractures the target. If, on the other hand, the width of the charge is approximately twice the thickness of the target, and the thickness of explosive sufficient only to give a pressure pulse of sufficiently short duration, then the fracturing mechanism consists of the coincidence of reflected tension waves from the far side of the target surface. These reflected tension waves cause a sudden application of tensile forces across the plane of intended fracture, and the target splits from the distal surface towards the surface on which explosive was placed. In practice, both mechanisms usually occur at the same time, with one of the two mechanisms clearly preponderant.

One explosive cutting charge using such a mechanism is disclosed in European Patent No. 0043215 wherein a series of detonation wave collision charges are arranged in cavities in a continuous rubber matrix. This charge has a small degree of flexibility in the fracture plane but little or no lateral flexibility. Another linear cutting charge is disclosed in U.K. patent application No. 8513325 wherein a prism or lens-section strip of inert material is interposed between a strip of explosive and the target. This has the effect of focusing the explosively generated shock wave along the intended fracture plane within the target. Although this linear cutting charge can be made inherently but weakly magnetic by the use of magnetic rubber for forming the wave-shaping element, it again has the practical disadvantage of only very limited flexibility so that its stiffness coupled with a tendency to elastically recover its initial shape remain limiting factors when the cutting charge is used in practice.

The present invention has as its object to provide a linear explosive cutting or fracturing charge, and an element for use in forming same, which overcomes or mitigates the problem of inflexibility common to known linear cutting charges and to enable a linear cutting or fracturing charge of a required length to be produced quickly and easily.

The present invention provides an element for use in forming a linear explosive cutting or fracturing charge, the element comprising a body portion for receiving an explosive material and connecting means comprising first and second connector parts at opposite sides of the body portion whereby two or more said elements can be connected together for articulation relative to one another characterised in that a first initiation channel extends between the first and second connector parts, the first initiation channel being adapted to receive an explosive material to initiate, in use, detonation of explosive material in said body portion, the element being constructed and arranged such that when a plurality of elements are connected together, the first initiation channels are connected end to end.

The present invention also provides a linear explosive cutting or fracturing charge when formed from a plurality of elements according to the present invention connected together to form a chain and charged with explosive material.

The said connecting means may provide a hinge connection or, more preferably, a universal joint.

It will be appreciated that because the elements of a linear cutting or fracturing charge according to the present invention can be articulated relative to one another, the linear cutting or fracturing charge can be conformed to surfaces which are not flat. It will also be appreciated that any required number of elements can be connected together to provide a linear cutting charge of a required length.

Preferably, said connecting means comprises a first connector part on one side of the body portion and a second connector part on the opposite side of the body portion, the first and-second connector parts being adapted to connect with the second and first connector parts respectively of further similar elements. Said first and second connector parts may be complementary parts of snap-fit connectors whereby a plurality of said elements can be quickly and easily snap-fit together. Said first connector part may be a ball member and said second connector part may be a complementary socket member, whereby two or more elements can be connected together by engaging the ball member of one element in the socket member of an adjacent element to provide a universal ball-and-socket joint between the two elements.

Said body portion may comprise a recess for receiving said explosive material. Thus, the body portion may comprise a bottom wall and at least one peripheral wall extending outwardly of said bottom wall to define said recess. According to one embodiment, said at least one peripheral wall comprises opposed side walls and opposed end walls and said connecting means is located midway along said side walls.

Said body portion may comprise initiation means on that side thereof opposite said recess. The initiation means may comprise a first channel extending centrally across said body portion, e.g., between said connecting means, second and third channel extending outwardly on either side of the first channel and communicating with the first channel and apertures in the body portion communicating the outer extremities of said second and third channels with said recess, said channels and said apertures being adapted to receive explosive material. Said channels may be defined by walls upstanding from said bottom wall on that surface of the bottom wall opposite said peripheral wall. The walls of said second and third channels may diverge outwardly from said first channel and said apertures may comprise a slot in said bottom wall at the outer extremity of each of the second and third channels and adjacent a said end wall.

The body portion may further comprise at least one recess for receiving a magnet which will enable the element to be magnetically sectored to a ferrous target.

The element may further comprise a cover member for closing said channels. Said cover member may be a snap, friction or force fit with the upstanding walls defining said channels and may comprise means for supporting a detonator at one end of said first channel.

Preferably, said connecting means are of hollow thin-walled construction. When a plurality of elements in accordance with the invention are connected together so that the first initiation channels thereof are connected end to end, the channels provide a continuous initiation train extending over the length of the linear cutting or fracturing charge. Thus, with the channels and the hollow connecting means filled with explosive material detonation can proceed in either direction from one element to adjacent elements through the thin end walls of the adjacent connector parts. As detonation of the explosive material in the first channel of each element takes place, so detonation proceeds outwardly along the second and third channels of the element and through said apertures at the extremities of the second and third channels to initiate detonation of the main explosive charge contained in said recess from opposite outer extremities thereof. In this way, detonation of the main explosive charge contained in said recess proceeds from the opposite outer extremities thereof inwards towards the intended line of cut to provide the most efficient detonation configuration and to maximise the proportion of explosive energy imparted to the target. With such an arrangement the proportion of explosive energy affecting the target greatly exceeds that of conventional linear explosive charges in which detonation proceeds in a direction parallel with the intended line of cut.

The linear explosive or fracturing charge of the present invention also has advantages over conventional linear cutting charges when used for cutting cylindrical targets such as large diameter steel pipes. When a conventional linear cutting charge of the kind wherein detonation proceeds along the line of cut is applied to the outer circumference of a cylindrical target, the inner surface of the explosive cutting charge provides a shorter path around the target than does the outer surface so that as the detonation wave front progresses around the target there is a tendency for the detonation wave front to lean back progressively. This causes an ever increasing proportion of the explosive energy to be directed tangentially away from the target and to be wasted in the surrounding medium. Since, with the preferred embodiment of the present invention, the main charge of each element is initiated at the opposed outer extremities and proceeds inwardly towards the intended line of cut there is no tendency for the detonation wave front to lean backwards and comparatively little of the explosive energy is dissipated in the surrounding medium.

In order to ensure that detonation of the main charge of each element proceeds from opposite outer extremities thereof inwardly towards the intended line of cut, it is necessary to prevent the direct or sympathetic initiation of the main charge of one element by the detonation of the main explosive charge of a preceding element. This may be accomplished by spacing the adjacent elements sufficiently far apart by said connecting means as to delay or prevent direct initiation or by interposing an inert barrier element between the main explosive charges of adjacent elements. Such an inert barrier may conveniently be provided by a magnetic element which will serve the dual functions of providing an inert barrier and enabling the elements to be magnetically secured to a ferrous target.

The tendency towards sympathetic initiation between the main charges of adjacent elements may be further mitigated by the use of an explosive material of relatively high detonation velocity for the initiation train. This ensures that the desired initiation pattern of one element is further advanced before the shock wave arrives from the initiation of the main explosive charge of the preceding element than would be the case if a single explosive material were used both for the main charge and the initiation train.

As mentioned above, it is desirable that any particular element be in a sufficiently advanced state of initiation before the destructive effects of the preceding element destroy it, or damage it to an extent that would impair its correct functioning.

The potentially destructive mechanism of the preceding element consists of the generation of a violent, forward-travelling shock wave generated by the coincidence of the two shock waves generated by the two converging detonation waves of that charge. The forward velocity of such a shock wave may, in some cases, exceed the detonation velocity of explosive otherwise suitable for use in the present invention, and its effect would be to induce initiation of the subsequent charge prematurely at a point on its side; such premature initiation would generate a third detonation front which interferes detrimentally with those fronts intentionally generated at the outer edges of the element.

Greater separation of the elements mitigates this tendency, but such separation is detrimental to the performance of the charge array. Use of an explosive of lower velocity than that in the initiation train would tend to delay the generation of the destructive, forward-directed shock wave, but such explosive would be less effective at fracturing or cutting the target.

A preferred method of diminishing or eliminating this undesirable effect utilises the so-called "channel" effect, wherein the explosive of the initiation means is provided with a hole or holes extending longitudinally along one or more of the first, second and third channels. The hole or holes may be lined with thin-walled metal, plastic or ceramic, and is filled with air or other gas. The detonation products of that part of the explosive first detonated are driven along the hole at a velocity exceeding the normal velocity of detonation of that explosive, and initiate detonation in that part of the explosive not yet reached by the normal detonation wave front. The detonation velocity is thus effectively raised in that part of the explosive adjacent to the hole.

A rod or cylinder of explosive, provided with such a channel, and initiated at one end, therefore attains a detonation velocity substantially higher than that of an otherwise similar body of explosive not thus provided.

Although it is preferred that initiation of the main charge of each element proceeds from opposite outer extremities thereof inwardly towards the intended line of cut, the present invention can equally well be applied to simple concussion charges. In this case, initiation of the main explosive charge of each element may be along the centre line thereof, e.g. through said connector parts, in which case said second and third channels and said apertures would be omitted.

Figure 4:
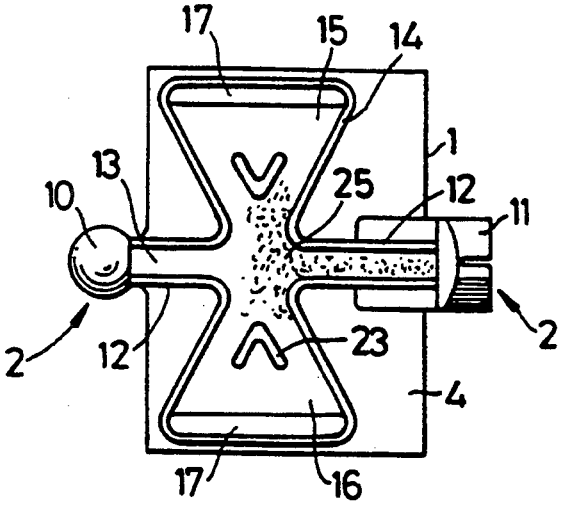
Figure 2:
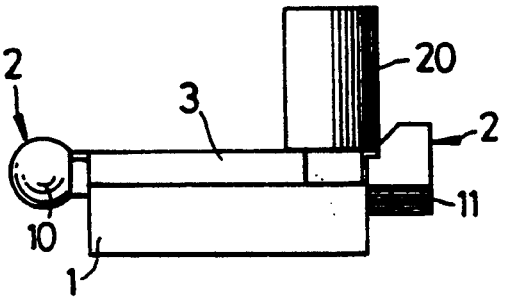
Figure 5:
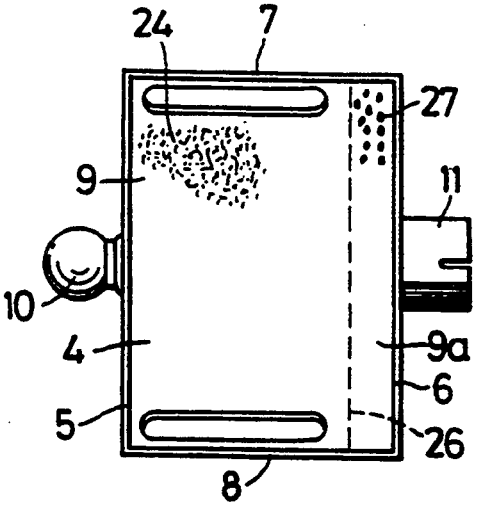
Figure 3:
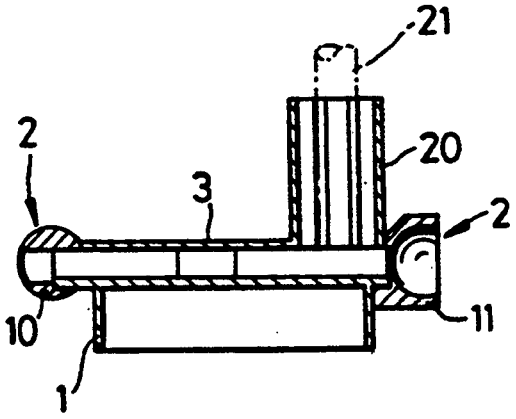
Figure 6:
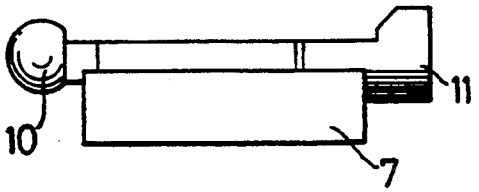
Figure 7:
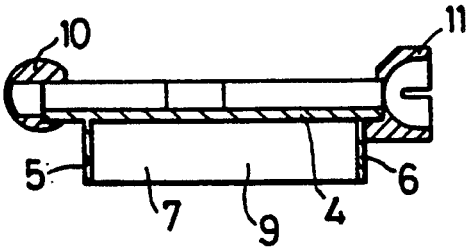
Figure 8:
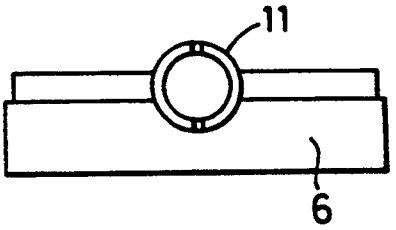
Figure 9:
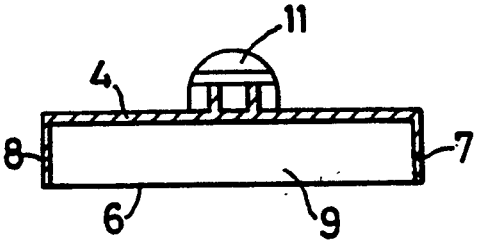
Figure 10:
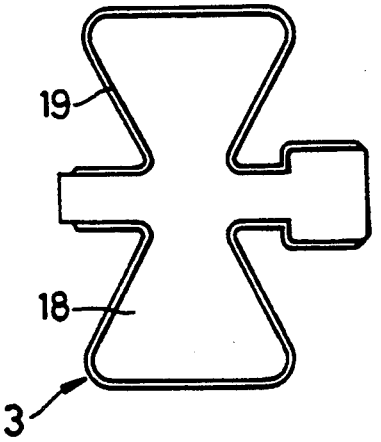
Figure 11:
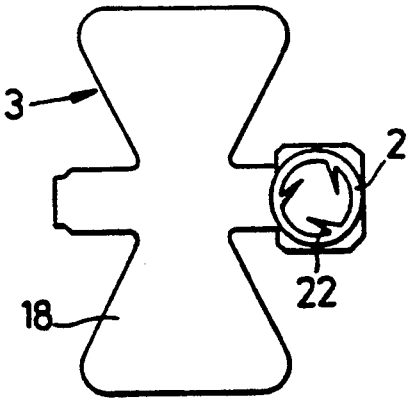
Figure 12:
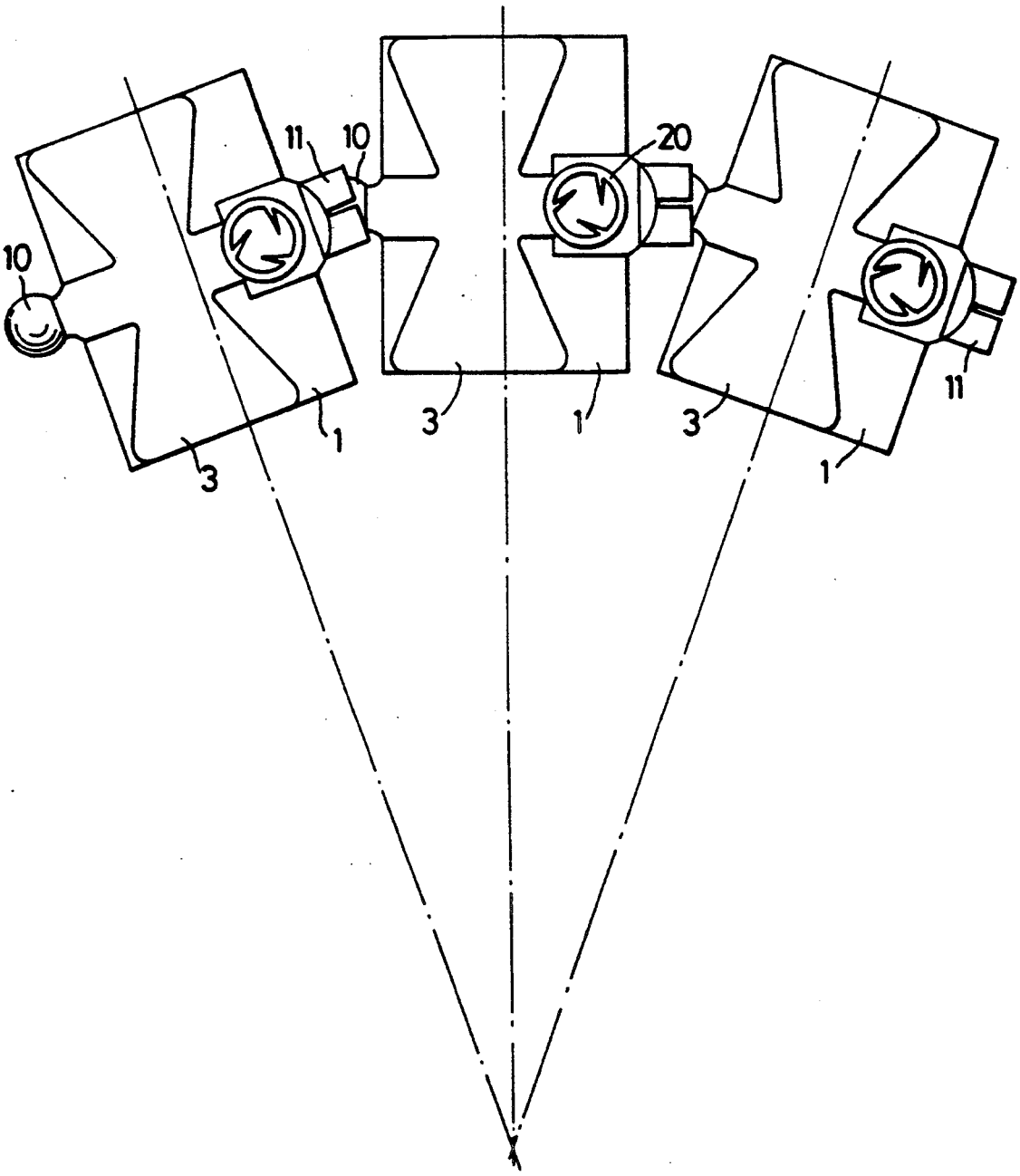

The present invention will be more particularly described with reference to the accompanying drawings, in which:

FIG. 1 is a top plan view of an element for use in forming a linear explosive cutting or fracturing charge according to the present invention, FIG. 2 is an end elevation of the element shown in FIG. 1, FIG. 3 is a sectional end elevation of the element shown in FIG. 1, FIG. 4 is a top plan view of a body portion of the element shown in FIG. 1, FIG. 5 is an underneath plan view of the body portion of the element shown in FIG. 1, FIG. 6 is an end elevation of the body portion shown in FIG. 4, FIG. 7 is a sectional end elevation of the body portion shown in FIG. 4, FIG. 8 is a side elevation of the body portion shown in FIG. 4, FIG. 9 is a side sectional elevation of the body portion shown in FIG. 4, FIG. 10 is an underneath plan view of a cover member of the element shown in FIG. 1, FIG. 11 is a top plan view of the cover member shown in FIG. 10, and FIG. 12 is a plan view showing a plurality of elements according to FIG. 1 connected together into a chain to form a linear explosive cutting or fracturing charge according to the present invention.

Referring to FIGS. 1 to 3 of the drawings, it will be seen that the element illustrated therein comprises a body portion 1, connecting means 2 and cover member 3.

Referring now also to FIGS. 4 to 9 it will be seen that the body portion 1 comprises a bottom wall 4, opposed side walls 5, 6 and opposed end walls 7, 8 depending from the bottom wall 4 to define a recess 9 for receiving a main charge of explosive material.

The connecting means 2 comprises a first connector part in the form of a ball member 10 and a second connector part in the form of a complementary socket member 11, the arrangement being such that the ball member 10 of one element is a snap fit with the socket member 11 of another similar element to provide an articulated universal ball-and-socket joint between the adjacent elements as illustrated in FIG. 12.

Upstanding from the bottom wall 4 are parallel walls 12 defining a first, main, initiation channel 13 and walls 14 which diverge outwardly from the walls 12 and define second and third initiation channels 15 and 16. Slots 17 in the bottom wall 4 communicate the outer extremities of the second and third initiation channels 15 and 16 with the recess 9 adjacent the end walls 7 and 8. The main initiation channel 13 extends centrally of the body portion 1 between the ball member 10 and socket member 11. Ball member 10 and socket member 11 are of hollow thin-walled construction so that detonation of an initiation train of explosive material contained in the channels 13 and members 10 and 11 of adjacent elements can proceed through said thin walls to the main initiation channel 13 of an adjacent element.

Cover member 3 illustrated also in FIGS. 10 and 11 comprises a top wall 18 and depending side walls 19 which are a snap, force or friction fit with the walls 12 and 14 defining the channels 13, 15 and 16. A cylindrical holder 20 for a detonator 21 (FIG. 3) is upstanding from the cover member 3 and has flexible tangential ribs 22 extending inwardly thereof for accommodating detonators of different diameters.

Delay elements 23 may be provided in the second and third initiation channels 15 and 16 to ensure that the detonation fronts proceeding outwardly therealong towards the slots 17 proceed parallel to the slots 17.

In use, the recess 9 is filled with a main charge 24 (FIG. 4) of explosive material and the initiation channels 13, 15 and 16 are filled with an initiating charge 25 of explosive material. Advantageously, the explosive material 25 is of a higher detonation velocity than the explosive material 24. The explosive material 25 communicates with the explosive material 24 through the slots 17 which are also filled with one or other of the explosive materials. With this arrangement initiation of the main explosive charge 24 is from the outer extremities thereof with detonation proceeding inwardly towards the intended line of cut, which is along the centre line of the element extending through the ball member 10 and socket member 11. As many elements charged with explosive material as required can be connected together as illustrated in FIG. 12 in the form of a chain to provide a linear explosive cutting or fracturing charge of any required length. Initiation of the explosive charges can be from any one or more of the elements and will then proceed outwardly in both directions along the main initiation channels of the adjacent elements.

The initiation channels may, if desired, be provided with longitudinal holes which may be lined with thin-walled metal, plastic or ceramic and filled with air or other gas. The holes suitably extend substantially centrally of the explosive in each channel.

As outlined above, the provision of such holes eliminates, or greatly mitigates, the problem of premature, mid-line initiation. By way of example, an 8 millimetre rod of the plastic explosive SX2, whose normal detonation velocity was found to be approximately 7,200 metres a second in that form, detonated at a velocity of approximately 9,100 metres a second when provided with an air-filled axial channel 3.2 millimetres in diameter.

As can be seen from FIG. 12, due to the articulation of the connected elements by means of the ball-and-socket joints, the linear cutting charge of the present invention can adapt a required radius of curvature to provide arcuate cuts and/or to accommodate cylindrical or other non-planar targets.

If desired the recess 9 may be divided by a partition wall 26 shown diagramatically in FIG. 5 to provide a supplementary recess 9*a*. Supplementary recess 9*a* may contain explosive material 24 or, more preferably, an inert barrier element which may be in the form of a sintered ferrite or other magnet 27 which will serve both as a barrier to prevent sympathetic detonation of the main explosive charge 24 by the detonation of the main explosive charge of a preceding element and also to magnetically attach the element to a ferrous target.

The element of the present invention may be moulded or formed from plastics material or rubber. A particularly suitable material is acrylonitrile butadiene styrene (ABS) plastics material.

The following examples are given by way of illustration.

EXAMPLE 1

A linear cutting charge was assembled using the elements illustrated in FIGS. 1 to 3 of the drawings. The plastic explosive PE4 was used for both the main charge and initiation train and was inserted in the recess 9 and channels 13, 15 and 16 of each element. The main charge of each element measured 50 ×28×19 mm and consisted of approximately 42 g of explosive. With a spacing of 18.5 elements per metre this corresponded to an explosive load of 777 g/m.

The linear cutting charge was placed on the surface of a target consisting of a flat plate of 43A grade mild steel having a thickness of 50 mm. When the charge was detonated the target was cleanly fractured along the intended line of cut.

EXAMPLE 2

A linear cutting charge was assembled as described in Example 1 and was placed on the surface of a target consisting of a flat plate of 43A mild steel having a thickness of 40 mm. The cutting charge was arranged with the centre-lines of the individual elements on an arc of a circle of approximately 150 mm radius. When the charge was detonated the target was cleanly fractured along the intended arcuate line of cut.

I claim:

1. An element for use in forming a linear explosive cutting or fracturing charge, the element comprising a body portion for receiving an explosive material and connecting means comprising first and second connector parts at opposite sides of the body portion whereby two or more said elements can be connected together for articulation relative to one another characterized in that the body portion defines a first initiation channel which extends between the first and second connector parts with said first initiation channel having a hollow interior for receiving an explosive material and is adapted to initiate, in use, detonation of additional explosive material in said body portion, the first and second connector parts of the element being constructed and arranged such that when a plurality of the elements are connected together, the first initiation channels of the connected elements are connected end to end.

2. An element according to claim 1, wherein said first and second connector parts are complementary parts of snap-fit connectors.

3. An element according to claim 2, wherein said first connector part is a ball member and said second connector part is a complementary socket member.

4. An element according to claim 1, wherein said body portion comprises a recess for receiving said additional explosive material.

5. An element according to claim 4, wherein the first initiation channel is disposed on that side of the body portion opposite said recess.

6. An element according to claim 4, wherein said body portion comprises a bottom wall and at least one peripheral wall extending outwardly of said bottom wall to define said recess.

7. An element according to claim 6, wherein said at least one peripheral wall comprises opposed side walls and opposed end walls and said connecting means is located, viewed in plan, midway along said side walls.

8. An element according to any one of claims 5 to 7, wherein the first initiation channel extends centrally across the body portion and second and third initiation channels extend outwardly on either side of the first initiation channel and communicate with the first initiation channel and apertures in the body portion communicate with outer extremities of said second and third initiation channels with said recess, said initiation channels and said apertures being adapted to receive explosive material.

9. An element according to claim 8, wherein said initiation channels are defined by walls upstanding from said bottom wall on a surface thereof opposite said peripheral walls.

10. An element according to claim 9, wherein the walls of said second and third initiation channels diverge outwardly from said first channel and said apertures comprise a slot in said bottom wall at an outer extremity of each of the second and third channels and adjacent a said end wall.

11. An element according to claim 1, wherein said body portion comprises at least one recess for receiving a magnet or inert barrier member.

12. An element according to claim 1, having its body portion filled with said additional explosive material.

13. An element according to claim 8 having its body portion filled with said additional explosive material, and the explosive material in one or more of the initiation channels being provided within a longitudinally extending hole.

14. An element according to claim 9, comprising a cover member for closing said initiation channels.

15. An element according to claim 14, wherein said cover member comprises means for supporting a detonator at one end of said first initiation channel.

16. An element according to claim 1 connected to at least an additional one of said element to form a chain with each said element of said chain charged with explosive material.

* * * * *